US007017503B2

(12) United States Patent
Ahn et al.

(10) Patent No.: US 7,017,503 B2
(45) Date of Patent: Mar. 28, 2006

(54) CAP HOLDING DEVICE FOR EMBROIDERY MACHINE

(75) Inventors: Young Nam Ahn, Inchon (KR); Jong Soo Kim, Kyongki-do (KR)

(73) Assignee: Sunstar Precision Co., Ltd., Inchon (KR)

( * ) Notice: Subject to any disclaimer, the term of this patent is extended or adjusted under 35 U.S.C. 154(b) by 286 days.

(21) Appl. No.: 10/620,417

(22) Filed: Jul. 17, 2003

(65) Prior Publication Data

US 2004/0180987 A1 Sep. 16, 2004

(30) Foreign Application Priority Data

Mar. 13, 2003 (KR) ..... 20-2003-0007532

(51) Int. Cl.
*D05C 9/04* (2006.01)

(52) U.S. Cl. ..... 112/103

(58) Field of Classification Search ..... 112/103, 112/475.11, 470.14, 470.18, 102.5, 470.17, 112/470.29, 63

See application file for complete search history.

(56) References Cited

U.S. PATENT DOCUMENTS

| | | | | |
|---|---|---|---|---|
| 4,665,844 | A * | 5/1987 | Shibata | 112/103 |
| 5,553,560 | A * | 9/1996 | Tajima et al. | 112/103 |
| 5,884,572 | A * | 3/1999 | Kawaguchi | 112/103 |
| 5,915,314 | A * | 6/1999 | Moore, III | 112/103 |
| 6,273,012 | B1 * | 8/2001 | Hattori et al. | 112/103 |
| 6,532,882 | B1 * | 3/2003 | Tajima et al. | 112/103 |
| 6,708,632 | B1 * | 3/2004 | Shibata | 112/103 |

* cited by examiner

*Primary Examiner*—Ismael Izaguirre
(74) *Attorney, Agent, or Firm*—Greenblum & Bernstein, P.L.C.

(57) ABSTRACT

Disclosed is a cap holding device for an embroidery machine capable of easily mounting a cap while securely supporting the cap and improving workability and productivity. The cap holding device has a holding member for mounting the cap thereon, a pressing member detachably coupled to the holding member so as to maintain the cap in the holding member, and at least one fixing part formed at one end or both ends of the pressing member and fixed to the holding member.

13 Claims, 15 Drawing Sheets

CAP HOLDING DEVICE FOR EMBROIDERY MACHINE

BACKGROUND OF THE INVENTION

1. Field of the Invention

The present invention relates to a cap holding device for holding a cap embroidered in an embroidery machine, and more particularly to a cap holding device for an embroidery machine, which reliably supports a cap while easily mounting the cap thereon.

2. Description of the Prior Art

As generally known in the art, a conventional cap holding device for an embroidery machine does not easily mount a cap thereon, so working time is increased. In addition, the conventional cap holding machine does not tensely maintain the cap, so that the cap is easily wrinkled and deformed. For this reason, embroidery designs are sometimes formed in a wrong position of the cap, instead of a precise position of the cap, in contradiction to user's intention.

Hereinafter, a structure and problems of a conventional cap holding device will be described in detail with reference to FIGS. 1 and 2. FIG. 1 is a perspective view of a conventional cap holding device 50 for an embroidery machine, and FIG. 2 is a side view showing a cap mounted on the conventional cap holding device 50.

As shown in FIG. 1, the conventional cap holding device 50 includes a holding member 51 having a cylindrical shape for holding a cap and a pressing member 52 having a band shape for pressing the cap towards the holding member 51. The holding member 51 is provided at one end thereof with a flange section 53, which is vertically protruded from an outer wall of the holding member 51, and provided at the other end thereof with a saw-tooth type or a semicircular type protrusion, which is protruded at a right angle towards the outer wall of the holding member 51. The flange section 53 is formed with a pair of rods 54, which are positioned in adjacent to each other and extend along a central axis of the holding member 51. One of the rods 54 has a coupling member 57. The pressing member 52 is formed at one end thereof with a connection part 55, which is rotatably connected to one rod, and formed at the other end thereof with a fixing part 56 having a fastening unit, which is formed in the other rod and coupled to the coupling member 57. A perforation hole 52*a* is formed at a center of the pressing member 52 in order to allow a visor part P of the cap 10 to be freely inserted into the perforation hole 52*a*.

In order to mount the cap 10 on the cap holding device 50, an anti-sweating part B of the cap 10 is firstly withdrawn from a cap part C. Then, after placing the visor part P of the cap 10 in opposition to the rods 54, the cap 10 is put on the holding member 51 and rods 54.

Then, the anti-sweating part B is spread along the holding member 51 and the pressing member 52 surrounds the anti-sweating part B from an upper portion thereof, so that the fixing part 56 of the pressing member 52 is coupled to the coupling member 57, thereby holding the cap 10.

In this state, a rear section of the cap part C is downwardly pulled so as to tensely maintain an embroidery region A and to make a margin area at a rear side Cc of the cap part C. In addition, clips 59 are coupled to two rods 54 from upper portions of the rods 54, so that the cap 10 is held in the cap holding device 50 in a state that the margin of embroidery region A is moved towards the rear side of the cap part C.

However, the conventional cap holding device 50 requires to couple a plurality of clips 59 to the rods 54 while downwardly pulling the rear side Cc of the cap part C, thereby lowering workability. In addition, since a plurality of clips 59 are used for tensely maintain the embroidery region A, it is difficult to carry out the embroidery work if clips 59 are broken or missed.

In addition, since an embroidery needle applies relatively great pressure to the cap 10, the visor part P of the cap 10 must be securely fixed. For this reason, it is necessary to form the perforation hole 52*a* in the pressing member 52 in order to insert the visor part P of the cap 10 into the perforation hole 52*a*. Accordingly, when the pressing member 52 surrounds the anti-sweating part B after the anti-sweating part B has been spread along the holding member 51, the visor part P must be inserted into the perforation hole 52*a* in order to mount the cap 10 on the holding member 51. However, this kind of work is very difficult and requires long time for mounting the cap 10 on the holding member 51.

Furthermore, due to the inferior workability of the conventional cap holding device derived from the structure thereof, the embroidery region A cannot be tensely maintained, so that inferior embroidery designs are formed on the cap.

Therefore, there has been required to provide a cap holding device capable of solving above-mentioned problems.

SUMMARY OF THE INVENTION

Accordingly, the present invention has been made to solve the above-mentioned problems occurring in the prior art, and a first object of the present invention is to provide a cap holding device for an embroidery machine capable of reliably supporting a cap while easily mounting the cap thereon.

A second object of the present invention is to provide a cap holding device for an embroidery machine capable of improving workability and productivity by adopting a simple structure.

A third object of the present invention is to provide a cap holding device for an embroidery machine, which can be moved for an embroidery work.

A fourth object of the present invention is to provide a cap holding device for an embroidery machine capable of reducing manufacturing cost by simplifying a manufacturing process thereof.

A fifth object of the present invention is to provide a cap holding device for an embroidery machine capable of tensely maintaining inner portions of front and lateral parts of a cap regardless of depth of the cap, thereby improving quality of embroidery designs formed on the cap.

A sixth object of the present invention is to provide a cap holding device for an embroidery machine capable of tensely holding a cap in a precise position in such a manner that embroidery designs are precisely formed on an embroidery region according to predetermined embroidery design data.

In order to accomplish these objects, there is provided a cap holding device comprising a holding member for mounting a cap thereon, a pressing member detachably coupled to the holding member so as to maintain the cap in the holding member; and at least one fixing part formed at one end or both ends of the pressing member and fixed to the holding member.

According to the preferred embodiment of the present invention, the pressing member includes a first pressing member for maintaining an embroidery region in the holding member, and a second pressing member detachably coupled to a coupling part, at which the first pressing member is coupled to the holding member, so as to fix a non-embroidery region of the cap to the holding member.

The holding member includes a first supporting surface, a part of which is cut away, for supporting the embroidery region of the cap and a second supporting surface for supporting the non-embroidery region of the cap. The second supporting surface has two extension parts forwardly extending from both side ends of the first supporting surface and a connection part for connecting both ends of the extension parts to each other in parallel to the first supporting surface. A free end of the second supporting surface is positioned at a front of a moving route of a needle.

The extension parts are formed in such a manner that a curved line is formed from upper ends of the extension parts forming the second supporting surface to both side ends of the first supporting surface.

A means for receiving a second cap fixing part formed at a distal end of the second pressing member is formed at one of two extension parts of the second supporting surface.

A flange section outwardly extends at a right angle from lower portions of the first supporting surface and the extension parts of the second supporting surface, which extend from both side ends of the first supporting surface, and protrusion part is outwardly protruded at a right angle from an upper end of the first supporting surface.

A coupling member is vertically installed at one end of the flange section. The first and second pressing members are coupled to the coupling member. A coupling protrusion for the first pressing member is formed on the first supporting surface in opposition to the coupling member.

A fastening member is formed at a distal end of the first pressing member and a locking protrusion is formed at a distal end of the second pressing member. The fastening member of the first pressing member is coupled to the locking protrusion of the second pressing member for holding the cap in the holding member.

The first pressing member includes a pressing section having an elongated plate shape, a first expansion section extending widthwise from a first end of the pressing section, and a second expansion section extending widthwise from a second end of the pressing section. At least one "ㄷ" shaped fixing part fixed to the flange section is formed in the first expansion section and/or the second expansion section.

The second pressing member includes a second rotating part rotatably coupled to the coupling member and a handle section. The handle section has an upper member extending from an upper end of the second rotating part and having a shape corresponding to the connection part of the second supporting surface, a lower member extending from a lower end of the second rotating part while being spaced from the upper member by a predetermined distance and having a shape corresponding to the upper member, and a connection member for connecting the lower member to the upper member.

A second cap fixing part inserted into the receiving means formed in the extension parts of the second supporting surface is provided at an outer end of the connection member. A first cap fixing part extends from the second rotating part formed between the upper and lower members in such a manner that the first cap fixing part makes contact with the extension parts of the second supporting surface adjacent to the second rotating part. A locking protrusion is formed at an outer portion of the connection member in opposition to the lower member.

The cap holding device further comprises a cap-shape keeping section extending from a circumferential portion of the holding member and capable of adjusting height thereof so as to tensely maintain the cap according to a size of the cap.

The cap-shape keeping member includes a holding plate extending from the circumferential portion of the holding member and a cap-shape supporting part capable of adjusting height thereof so as to tensely maintain the cap based on a size of the cap.

The holding plate includes a pair of protrusion pins installed in the holding plate while spacing from each other by a predetermined distance, and the cap-shape supporting part includes a body section having a shape corresponding to a shape of the holding plate so as to easily make contact with the holding plate, a pair of elongated slots formed at a predetermined position of the body section corresponding to the protrusion pins and having a width sufficient for allowing the protrusion pins to be inserted into the elongated slots, and grooves formed at both sides of the body section.

An upper end of the cap-shape supporting part has a curved shape in order to smoothly maintain the cap when the cap is mounted on the cap holding device for an embroidery work and the cap-shape supporting part is coupled to the holding plate by a coupling means in a state that the protrusion pins are inserted into the elongated slots.

The holding device further comprises a holding clip inserted into the grooves in order to securely support the cap.

A flange section is outwardly protruded at a right angle from a lower portion of the holding member. First and second rods are installed on the flange section corresponding to both sides of the holding plate along a central axis of the holding member. A locking protrusion is installed in the second rod.

The pressing member includes a pressing section having an elongated plate shape, a first expansion section extending widthwise from a first end of the pressing section, and a second expansion section extending widthwise from a second end of the pressing section. The first expansion section has a hollow cylindrical rotating part rotatably coupled to the first rod. The second expansion section has a fastening member coupled to the locking protrusion formed in the second rod. At least one "ㄷ" shaped fixing part coupled to the flange section is formed in the first expansion section and/or the second expansion section.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
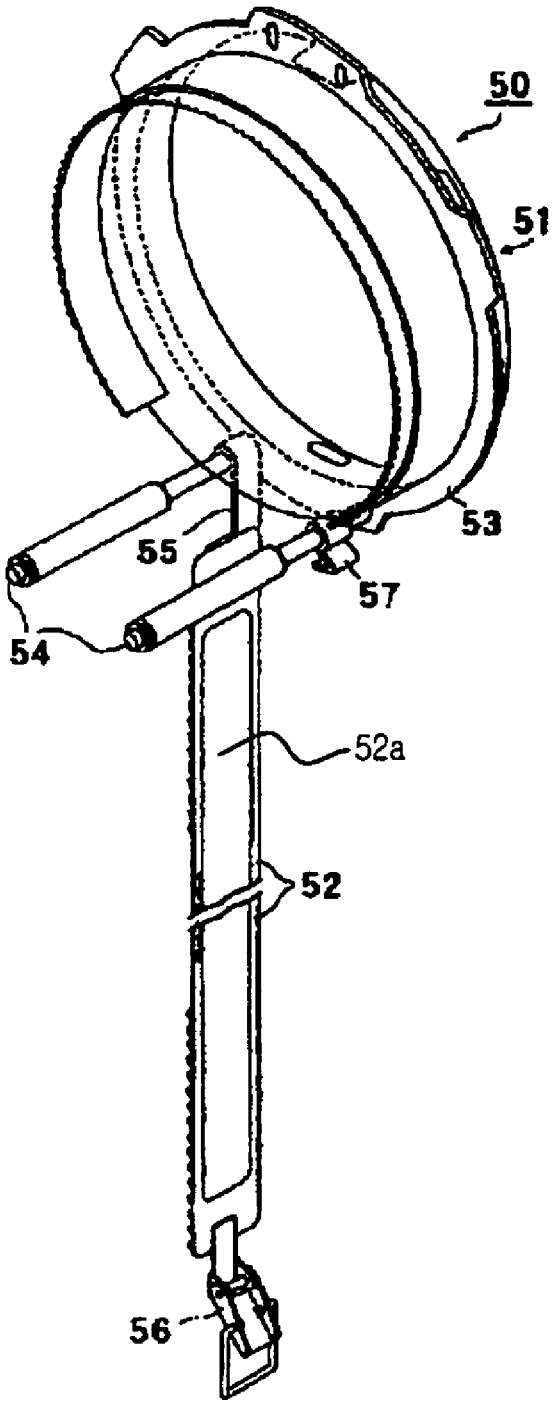
FIG. 1 PRIOR ART
FIG. 1 is a perspective view of a conventional cap holding device of an embroidery machine.
Figure 2:
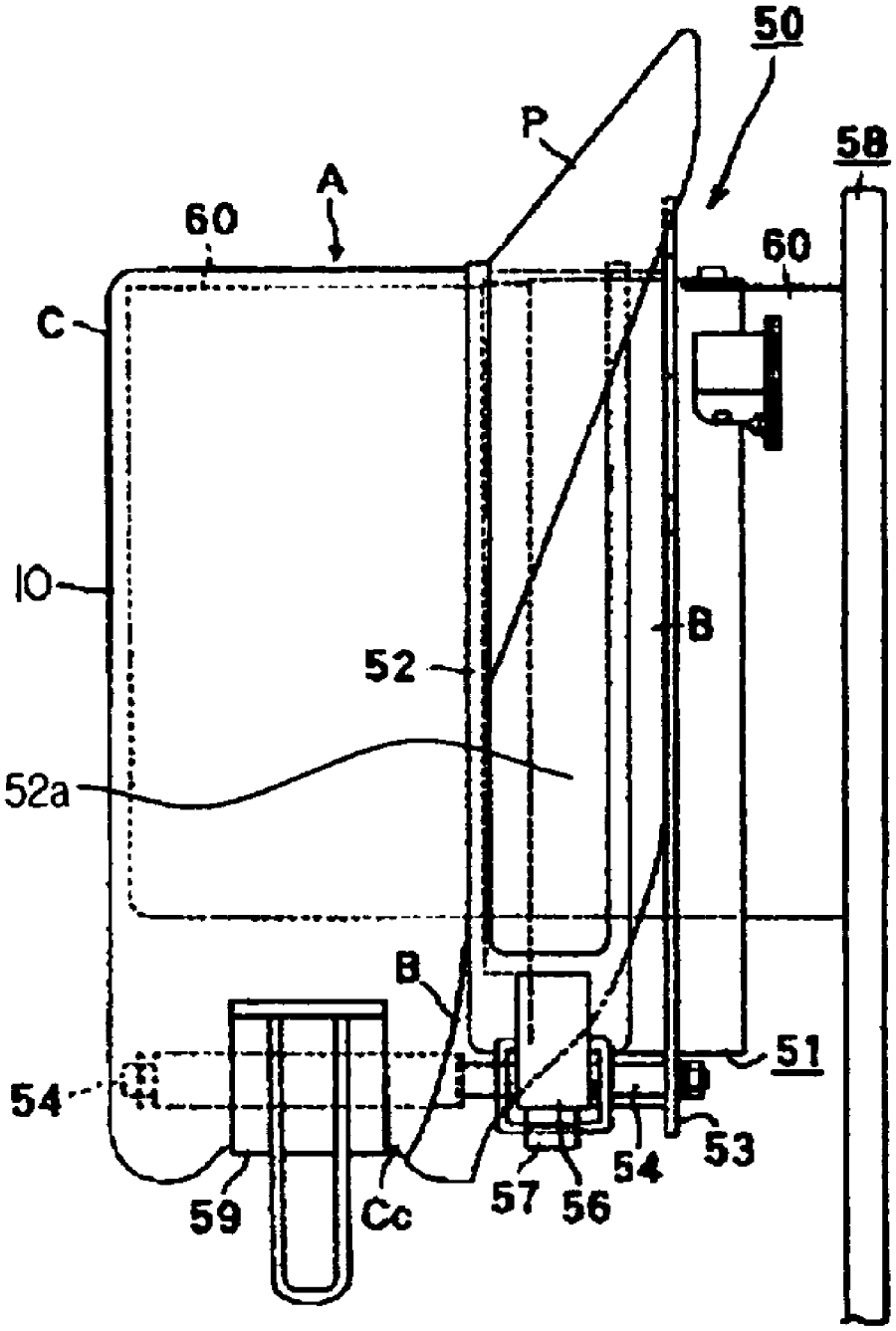
FIG. 2 PRIOR ART
FIG. 2 is a view showing a cap mounted on the conventional cap holding device shown in FIG. 1.

Hereinafter, a preferred embodiment of the present invention will be described with reference to the accompanying drawings. In the following description and drawings, the same reference numerals are used to designate the same or similar components, and so repetition of the description on the same or similar components will be omitted.

The present invention relates to a cap holding device 100 for holding and supporting a cap 10 in an embroidery machine, which forms a stitch by using upper and lower threads through an interaction between a rotary shuttle and a needle, which is vertically reciprocated. The cap holding device 100 includes holding members 110 and 110' for mounting the cap 10 thereon and pressing members 120 and 160 detachably coupled to the holding members 110 and 110' in order to maintain the cap 10 on the holding members 110 and 110'. At least one fixing part fixed the holding members 110 and 110' is formed at one end or both ends of the pressing members 120 and 160.

Hereinafter, a first embodiment of the present invention will be described with reference to FIGS. 3 to 10.

Figure 3:
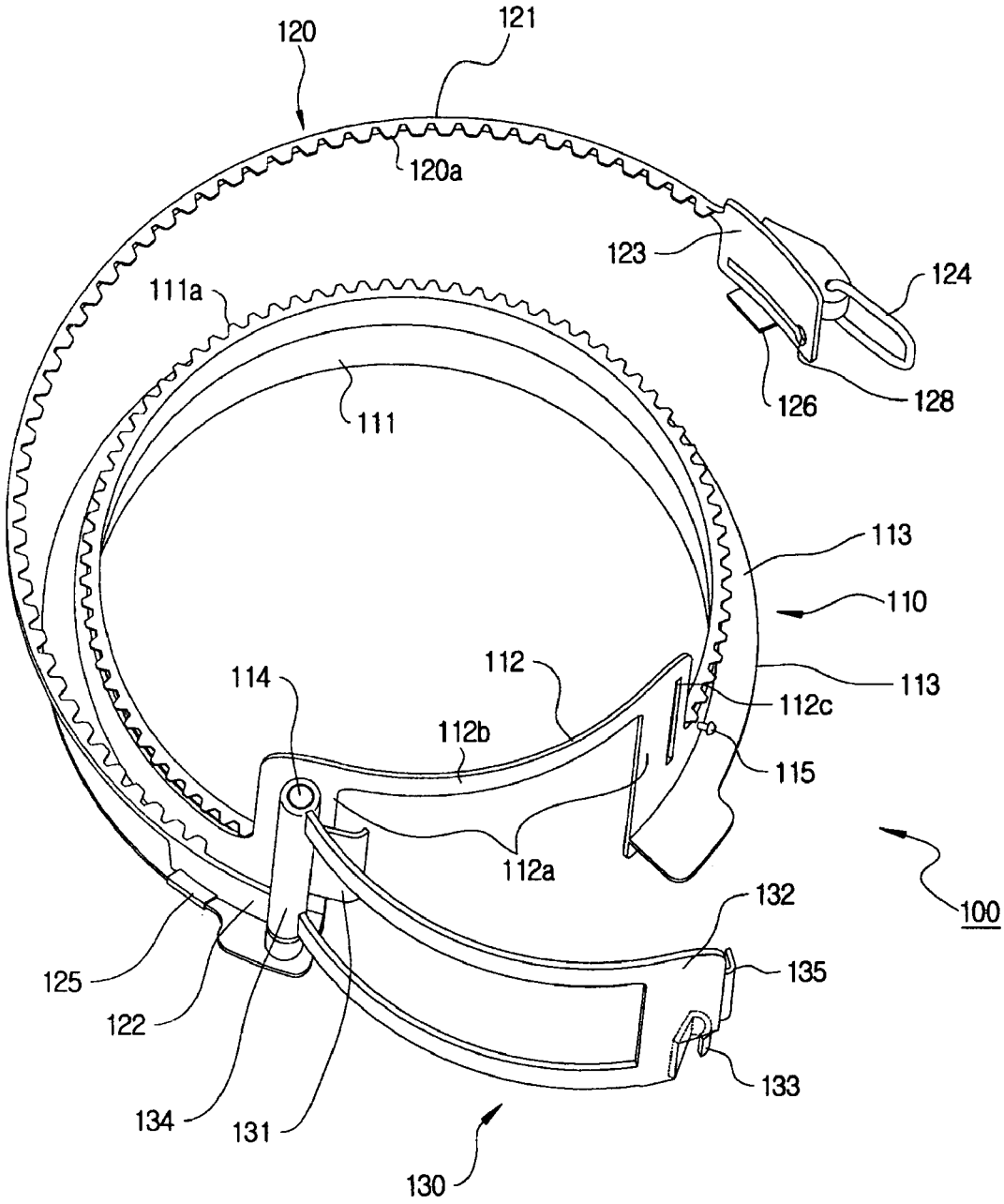
FIG. 3 is a perspective view of a cap holding device according to a first embodiment of the present invention.
Figure 4:
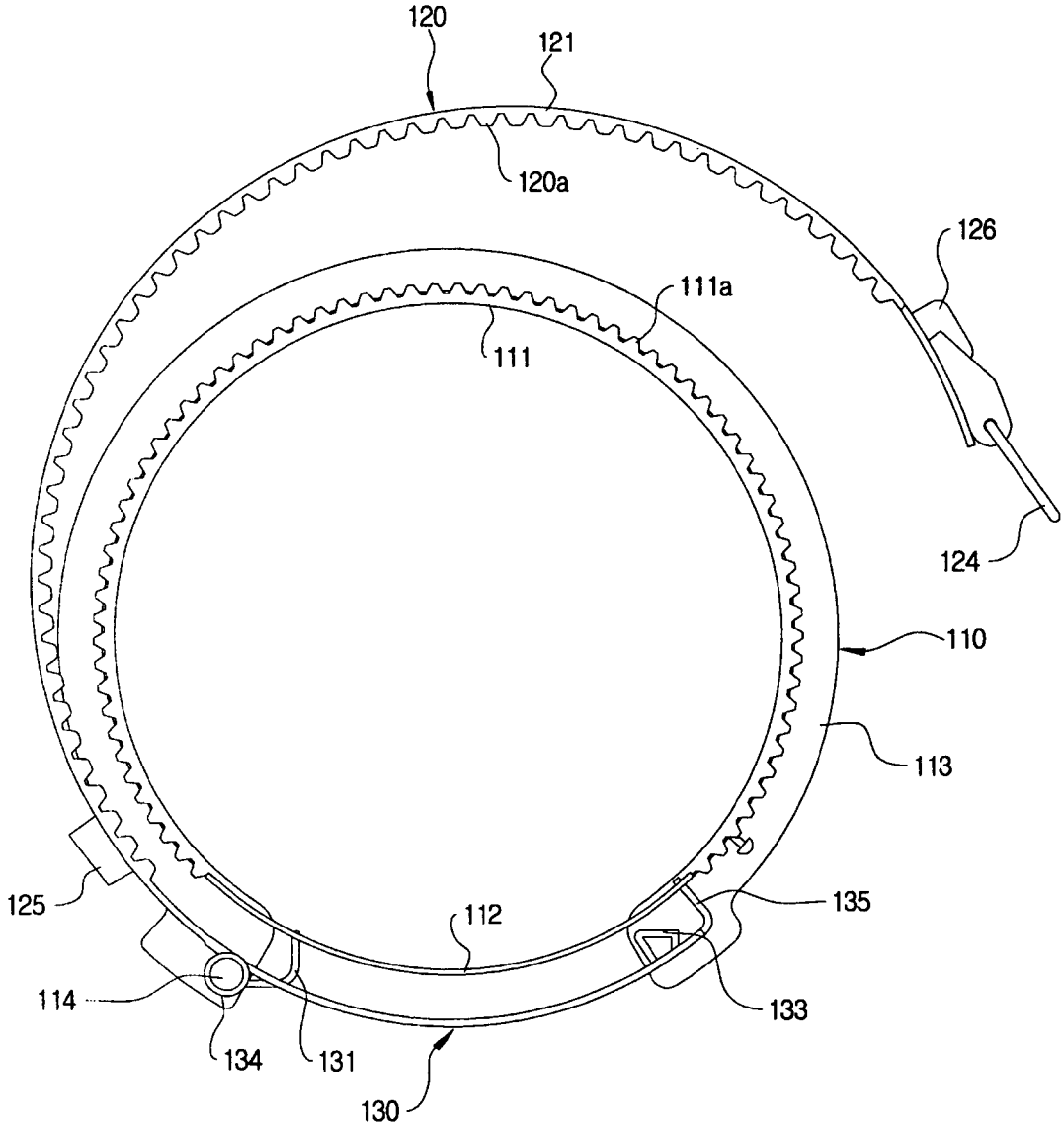
FIG. 4 is a front perspective view of a cap holding device shown in FIG. 3.

FIG. 3 is a perspective view of a cap holding device according to the first embodiment of the present invention and FIG. 4 is a front perspective view of the cap holding device shown in FIG. 3.

As shown in FIGS. 3 and 4, the cap holding device according to the first embodiment of the present invention includes a holding member 110 for mounting the cap 10 thereon, a first pressing member 120 detachably coupled to the holding member 110 for maintaining an embroidery region of the cap 10 within a range of the holding member 10, and a second pressing member 130 detachably coupled to a coupling portion between the first pressing member 120 and the holding member 110 so as to fix a non-embroidery region of the cap 10 to the holding member 110.

The holding member 110 has a first supporting surface 111 for supporting a lower side of the embroidery region of the cap 10 and a second supporting surface 112 for supporting a lower side of the non-embroidery region of the cap 10. The first supporting surface 111 has a substantially cylindrical shape, a part of which is cut away. The second supporting surface 112 includes two extension parts 112*a* forwardly extending from both sides of the first supporting surface 111 and a connection part 112*b* for connecting both ends of the extension parts 112*a* in parallel to the first supporting surface 111. A free end of the second supporting surface 112 is positioned at a front of a moving route of a needle when an embroidery work is carried out. The free end of the second supporting surface 112 extends in a predetermined direction, through which the cap 10 is mounted.

One of extension parts 112*a* of the second supporting surface 112 has a receiving slot 112*c* for receiving a second cap fixing part 135 formed at a distal end of the second pressing member 130.

The holding member 110 includes a flange section 113 and a semicircular or a saw-tooth type protrusion 111*a*. The flange section 113 is outwardly protruded at a right angle from lower portions of the first supporting surface ill and extension parts 112*a* of the second supporting surface 112. The saw-tooth type protrusion 111*a* is outwardly protruded at a right angle from an upper portion of the first supporting surface 111.

A coupling member 114 is vertically formed at one end of the flange section 113. Preferably, the coupling member 114 has a rod shape. The first and second pressing members 120 and 130 are coupled to the coupling member 114. A fixing protrusion 115 for fixing the first pressing member 120 can be formed at one end of the first supporting surface 111 in opposition to the coupling member 114.

That is, in order to forcibly fix the cap 10 to the holding member 110, the cap holding device 100 of the present invention includes the first pressing member 120 for pressing the cap 10 towards an upper portion of the first supporting surface 111 and the second pressing member 130 for pressing the cap 10 towards an upper portion of the second supporting surface 112.

A fastening ring 124 is provided at a distal end of the first pressing member 120, and a locking protrusion 133 is formed at a distal end of the second pressing member 130. The fastening ring 124 of the first pressing member 120 is coupled to the locking protrusion 133 so that the cap 10 is securely fixed to the holding member 110.

Both ends of the first pressing member 120 are formed with fixing parts 125 and 126 fixed to the flange section 113. At least one fixing part can be formed at one end or both ends of the first pressing member 120.

The first pressing member 120 includes a pressing section 121 having an elongated plate shape, a first expansion section 122 extending widthwise from one end of the pressing section 121, and a second expansion section 123 extending widthwise from the other end of the pressing section 121. The pressing section 121 has a first tooth part 120*a* extending towards the first supporting surface 111 from an upper portion of the pressing section 121 and having a semicircular shape or a saw-tooth shape. The first pressing member 120 is fabricated as a band shape by using elastic material. The first pressing member 120 can be elastically deformed in match with an outer peripheral portion of the holding member 110.

Figure 5:
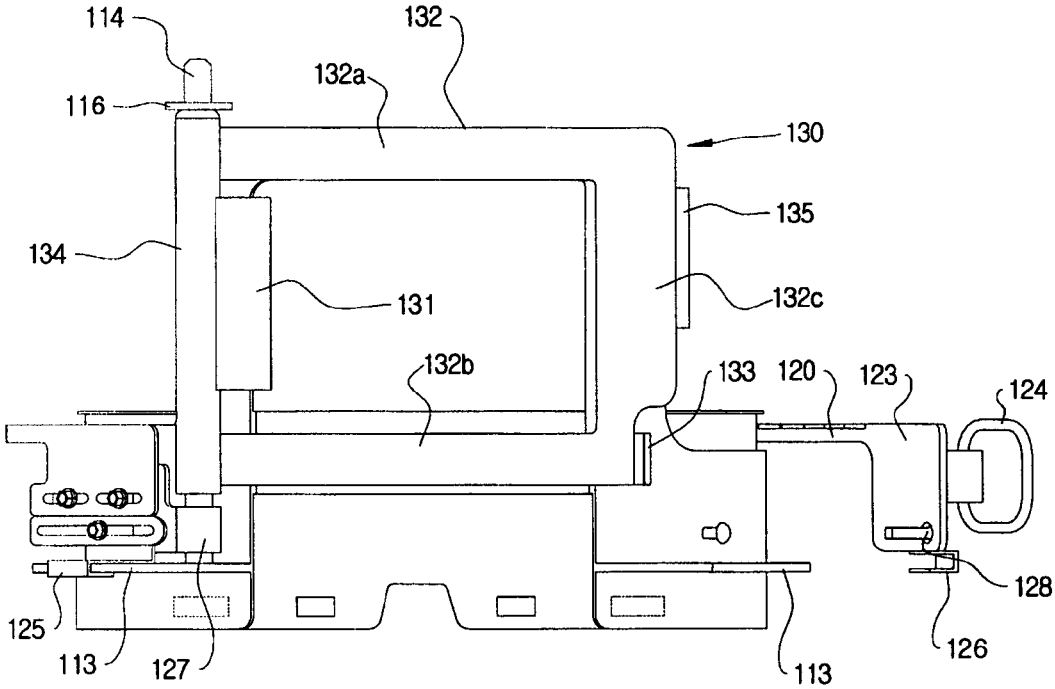
FIG. 5 is a bottom view of a cap holding device shown in FIG. 4.

Hereinafter, structures of the first and second pressing members 120 and 130 are explained in detail with reference to FIG. 5, which is a bottom view of the cap holding device shown in FIG. 4.

The first expansion section 122 of the first pressing member 120 includes a second tooth part (not shown) extending towards the first supporting surface 111 from an upper portion of the first expansion section 122, a first rotating part 127 rotatably installed at a distal end of the first expansion section 122, and at least one "ㄷ" shaped fixing part 125 formed in opposition to the second tooth part and coupled to the flange section 113.

The second expansion section 123 includes a third tooth part (not shown) extending towards the first supporting surface 111 from an upper portion of the second expansion section 123, a receiving slot 128 formed in opposition to the third tooth part for receiving the fixing protrusion 115, at least one "⊏" shaped fixing part 126 formed adjacent to the receiving slot 128 and coupled to the flange section 113, and a fastening ring 124 formed at a distal end of the second expansion section 123.

It is possible to selectively form at least one "z,900 " shaped fixing part at one of the first or second expansion sections 122 or 123.

In addition, the second pressing member 130 has a second rotating part 134 rotatably coupled to the coupling member 114 and a handle section 132. The handle section 132 includes an upper member 132*a* extending from an upper end of the second rotating part 134 and having a shape corresponding to the connection part 112*b* of the second supporting surface 112, a lower member 132*b* extending from a lower end of the second rotating part 134 while being spaced from the upper member 132*a* by a predetermined distance and having a shape corresponding to the upper member 132*a*, and a connection member 132*c* for connecting the lower member 132*b* to the upper member 132*a*. The second pressing member 130 can be made of elastic material.

The second pressing member 130 has a second cap fixing part 135 formed at an outer end of the connection member 132*c*. The second cap fixing part 135 is received in the receiving slot 112*c* formed at the extension parts of the second supporting surface 112 so as to securely fix the cap (referred to FIGS. 3 and 4). A first cap fixing part 131 (referred to FIG. 4) extends from the second rotating part 134 formed between the upper and lower members 132*a* and 132*b* in such a manner that the first cap fixing part 131 makes contact with the extension parts of the second supporting surface 112, which is adjacent to the second rotating part 134. Semicircular or saw-tooth type protrusions can be formed at end portions of the first and second cap fixing parts 131 and 132. The locking protrusion 133 is formed at an outer portion of the connection member 132*c* in opposition to the lower member 132*b*. In addition, a stopper 116 is provided to prevent the second rotating part 134 from being separated from the coupling member.

Figure 6:
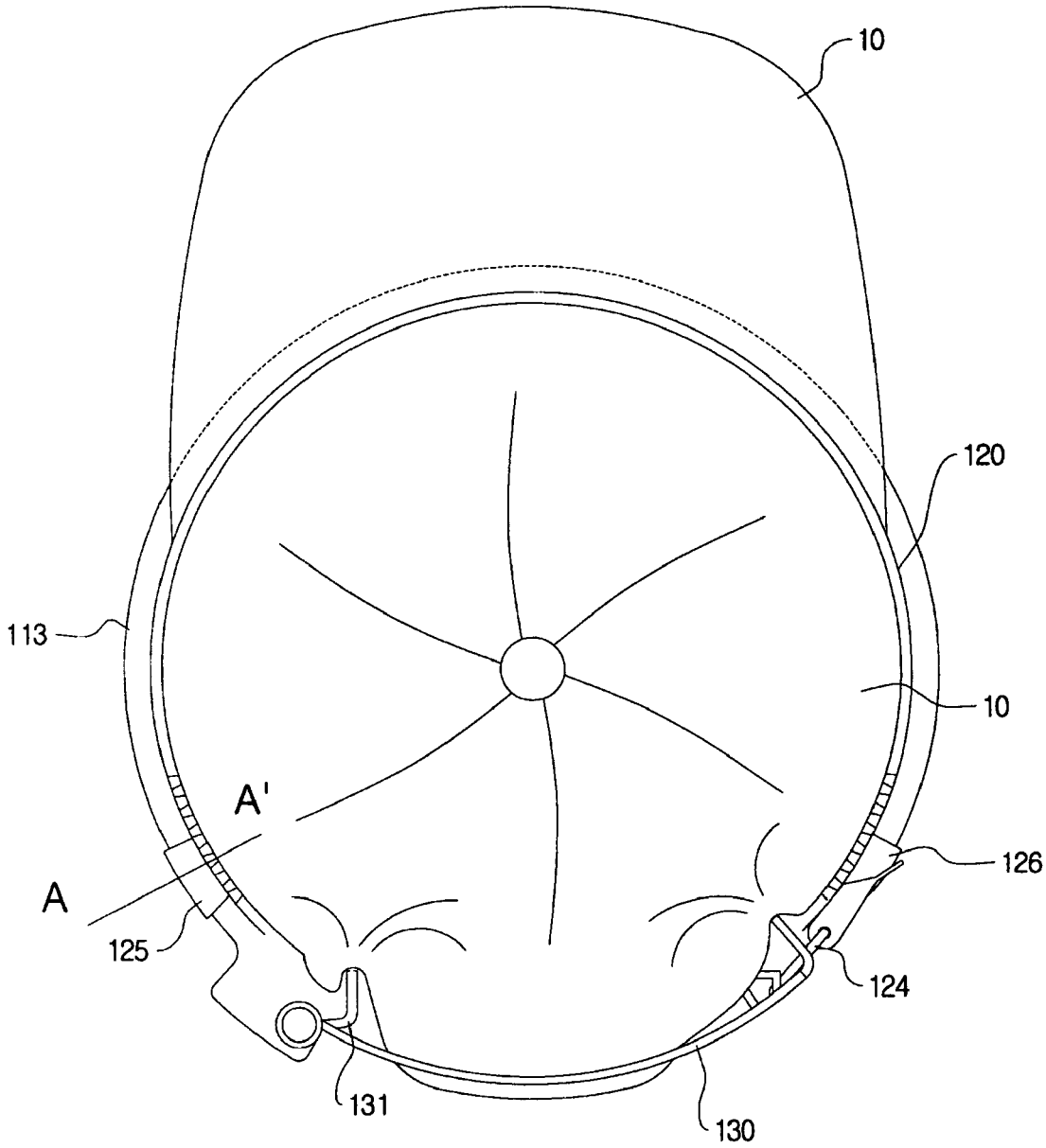
FIG. 6 is a plan view showing a cap mounted on a cap holding device shown in FIG. 3.
Figure 7:
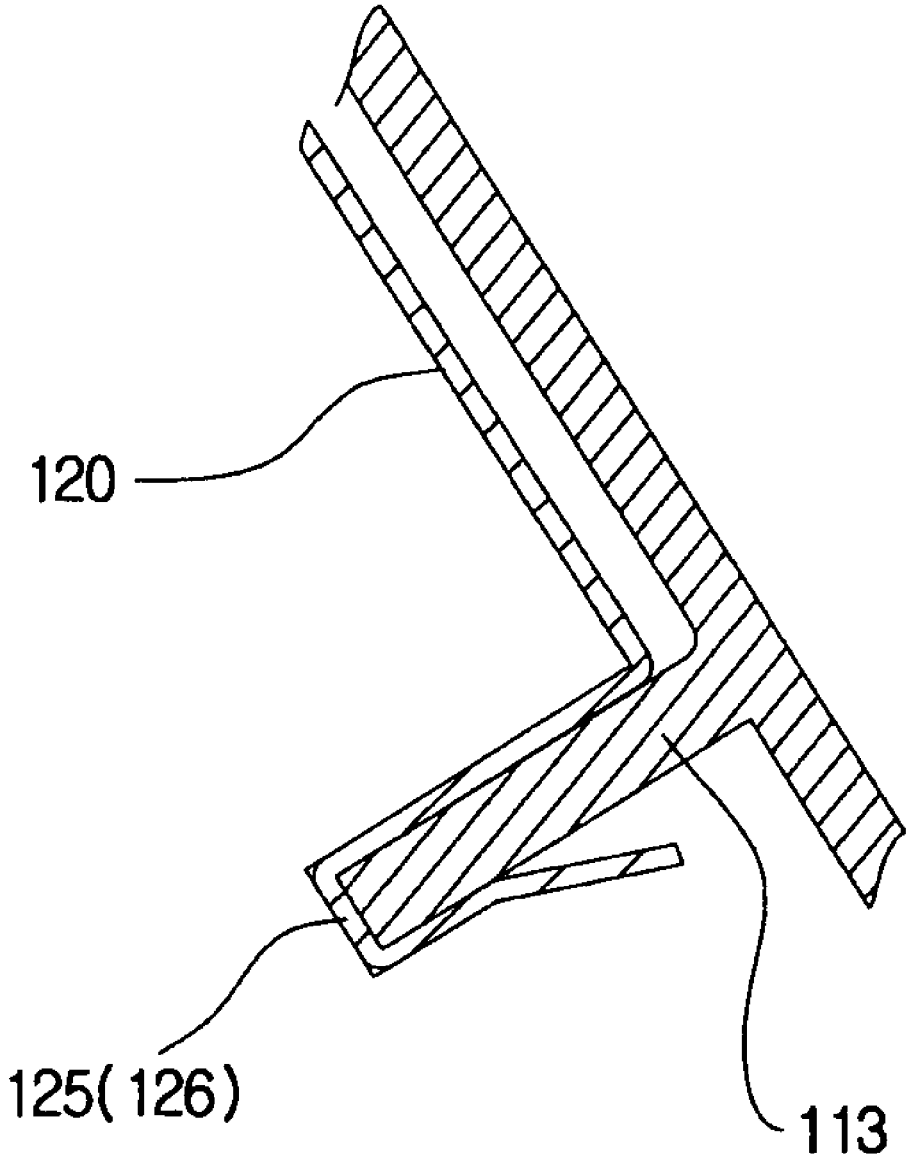
FIG. 7 is a sectional view taken along a line A–A' shown in FIG. 6.

FIG. 6 is a plan view showing the cap mounted on the cap holding device shown in FIG. 3 and FIG. 7 is a sectional view taken along a line A–A' shown in FIG. 6. Both ends of the first pressing member 120 has at least one "C"-shaped fixing part 125 or 126 fixed to the flange section 113 of the holding member 110. as shown in FIG. 7, the fixing part 125 or 126 formed at both ends of the first pressing member 120 is fixedly inserted into the flange section 113 formed at a rear side of the first supporting surface 111 of the holding member 110, so that the embroidery region of the cap 10 mounted on the first supporting surface 111 is pressed by the first pressing member 120, thereby securely fixing the cap 10. Therefore, the cap 10 is securely maintained in the cap holding device 100 even if external force is applied to the needle when performing the embroidery work, so that the embroidery work can be stably carried out. Accordingly, high-quality embroidery articles can be obtained.

Hereinafter, a method for mounting the cap on the cap holding device according to the first embodiment of the present invention will be described in detail.

Firstly, the fastening ring 124 of the first pressing member 120 is released from the locking protrusion 133 of the second pressing member in such a manner that the first and second pressing members 120 and 130 are released from the holding member 110 as shown in FIG. 3. In this state, the embroidery region of the cap 10 is positioned in the first supporting surface 111 of the holding member 110 and the non-embroidery region of the cap 10 is positioned in the second supporting surface 112 of the holding member 110.

Then, the first pressing member 120 is upwardly bent beyond the embroidery region of the cap 10 along a peripheral portion of the first supporting surface 111 and the second pressing member 130 surrounds the non-embroidery region of the cap 10 mounted on the second supporting surface 112 along a peripheral portion of the second supporting surface 112. Then, the fastening ring 124 of the first pressing member 120 is coupled to the locking protrusion 133 of the second pressing member 130. In order to couple the fastening ring 124 to the locking protrusion 133, "⊏"-shaped fixing part 125 or 126 formed at both side ends of the first pressing member 120 is fixed to the flange section 113 formed in the holding member 110 as shown in FIG. 7. The "⊏"-shaped fixing part 125 or 126 can be fixed to the flange section 113 of the holding member 110 by bending the first pressing member 120 along the peripheral portion of the first supporting surface 111.

In addition, in order to fix the second pressing member 130 to the second supporting surface 112, the second pressing member 130 surrounds the cap 10 along the peripheral portion of the second supporting surface 112 with respect to the non-embroidery region of the cap 10 mounted on the second supporting surface 112. Then, in a state that the cap 10 is tensely maintained, the pressing member 130 presses the cap to fix the cap 10. That is, the first and second cap fixing parts 131 and 135 of the second pressing member 130 presses the cap 10, thereby securely holding the cap 10.

Accordingly, the cap 10 can be securely mounted on the cap holding device 100, so the cap 10 is prevented from being moved in forward and backward directions even if external force is applied thereto when performing the embroidery work due to an operation of the needle. In addition, the embroidery region of the cap 10, such as a rim portion of the cap 10, can be prevented from being slid due to the protrusion 111*a* formed in the first supporting surface 111 of the holding member 110 and tooth part 120*a* formed in the first pressing member 120.

Figure 8:
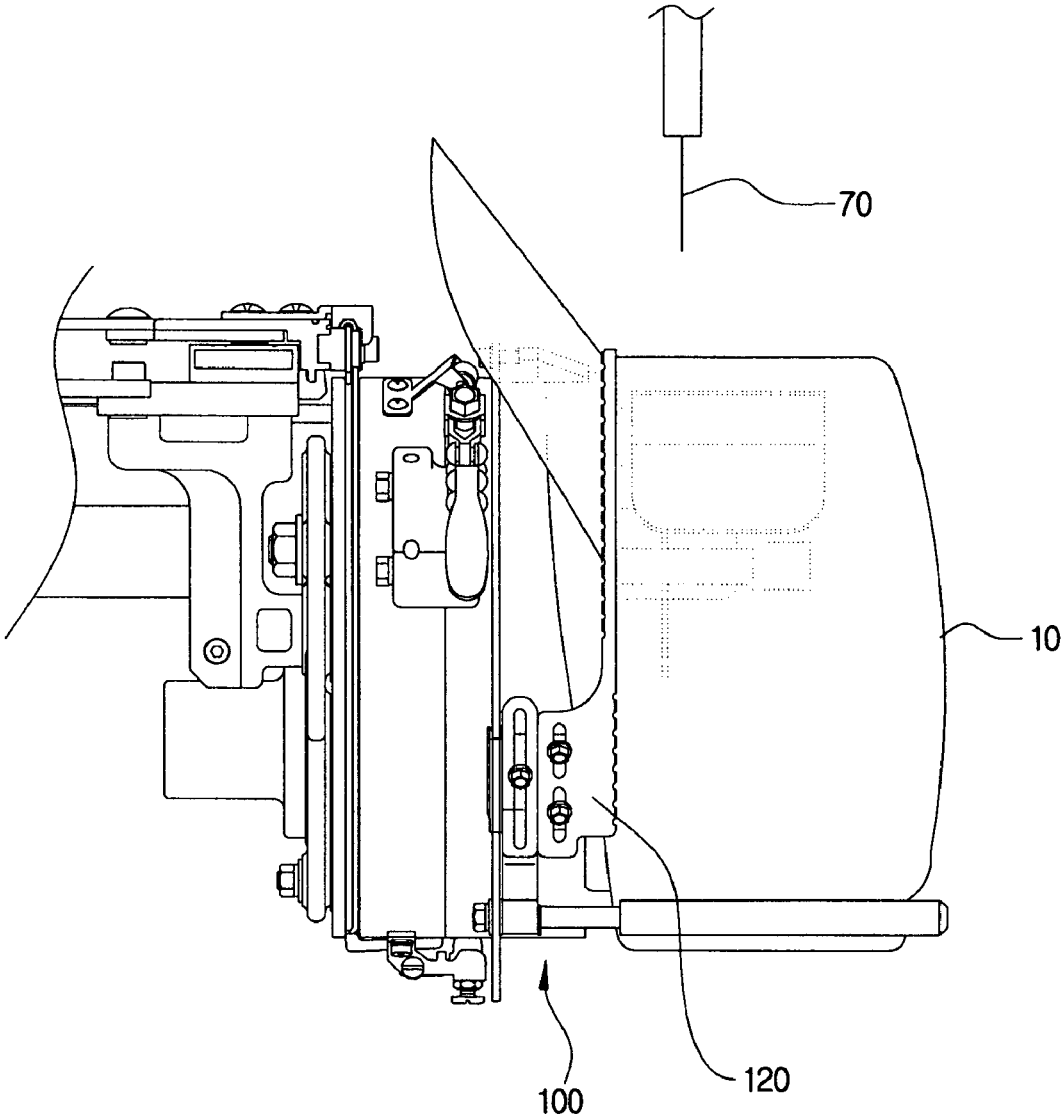
FIG. 8 is a left-side view showing a cap holding device shown in FIG. 6 mounted on a driving device of an embroidery machine.

FIG. 8 is a left-side view showing the cap holding device 100 having a cap shown in FIG. 6 mounted on a driving device of the embroidery machine.

As shown in FIG. 8, since the cap holding device 100 is rotated and moved in forward and backward directions by means of the driving device of the embroidery machine, when the cap holding device 100 having the cap 10 is mounted on the driving device of the embroidery machine, the cap holding device 100 driven by the driving device is rotated and moved in forward and backward directions according to embroidery design data and the needle 70 is moved up and down in cooperation with a shuttle (not shown), so that a predetermined embroidery design is formed on the cap 10.

Figure 9:
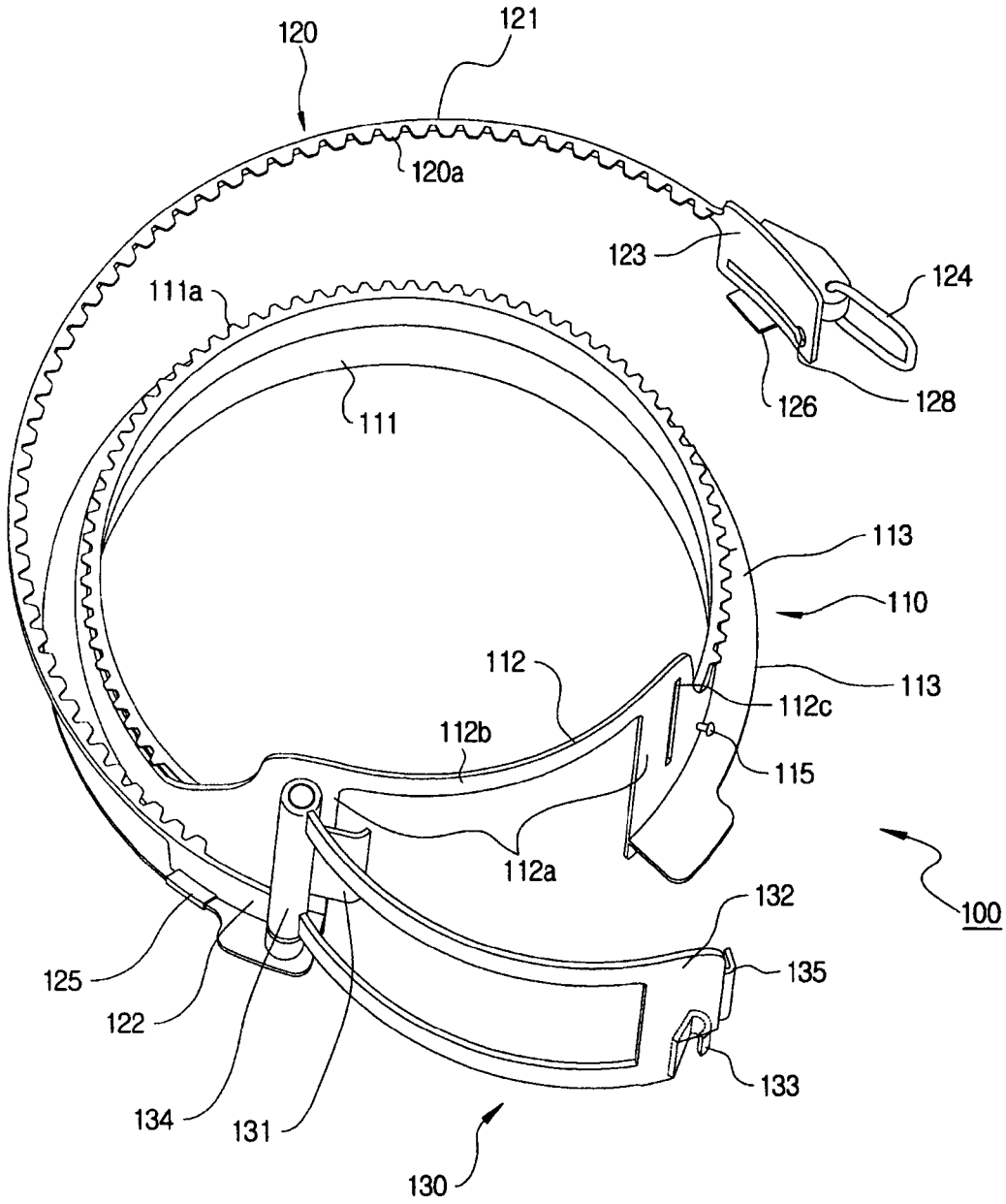
FIG. 9 is a perspective view of a cap holding device according to a second embodiment of the present invention.
Figure 10:
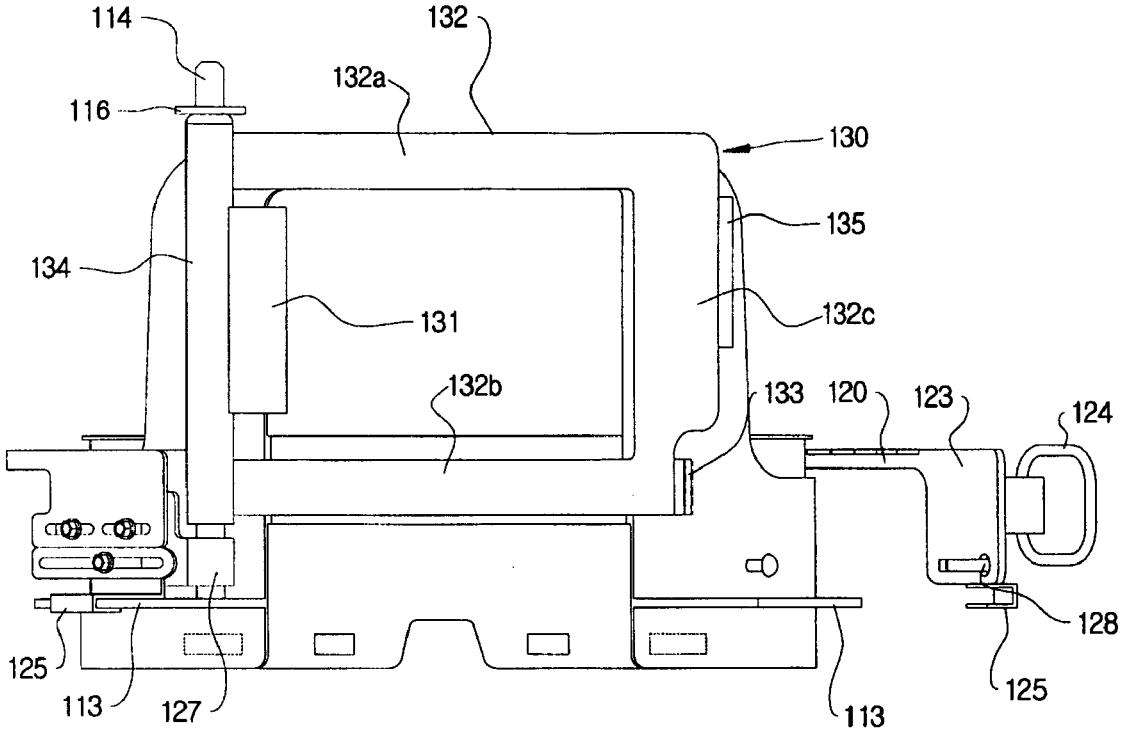
FIG. 10 is a bottom view of a cap holding device shown in FIG. 9.

FIGS. 9 and 10 shows a perspective view and a bottom view of the cap holding device 100 according to a second embodiment of the present invention, respectively.

The cap holding device 100 according to the second embodiment of the present invention has a structure substantially identical to the structure of the cap holding device 100 according to the first embodiment of the present invention, except for extension parts 112*a*, which are formed in such a manner that a curved line is formed from upper ends of the extension parts 112*a* forming the second supporting surface 112 of the holding member 110 to both side ends of the first supporting surface 111. In addition, the cap 10 can be mounted on the cap holding device 110 according to the second embodiment of the present invention with the same manner as the first embodiment. According to the present embodiment, the cap holding device provides a better outer appearance in view of design and more reliably holding the cap 10 as compared with the cap holding device of the first embodiment.

Hereinafter, a cap holding device according to a third embodiment of the present invention will be described in detail with reference to FIGS. 11 to 15.

Figure 11:
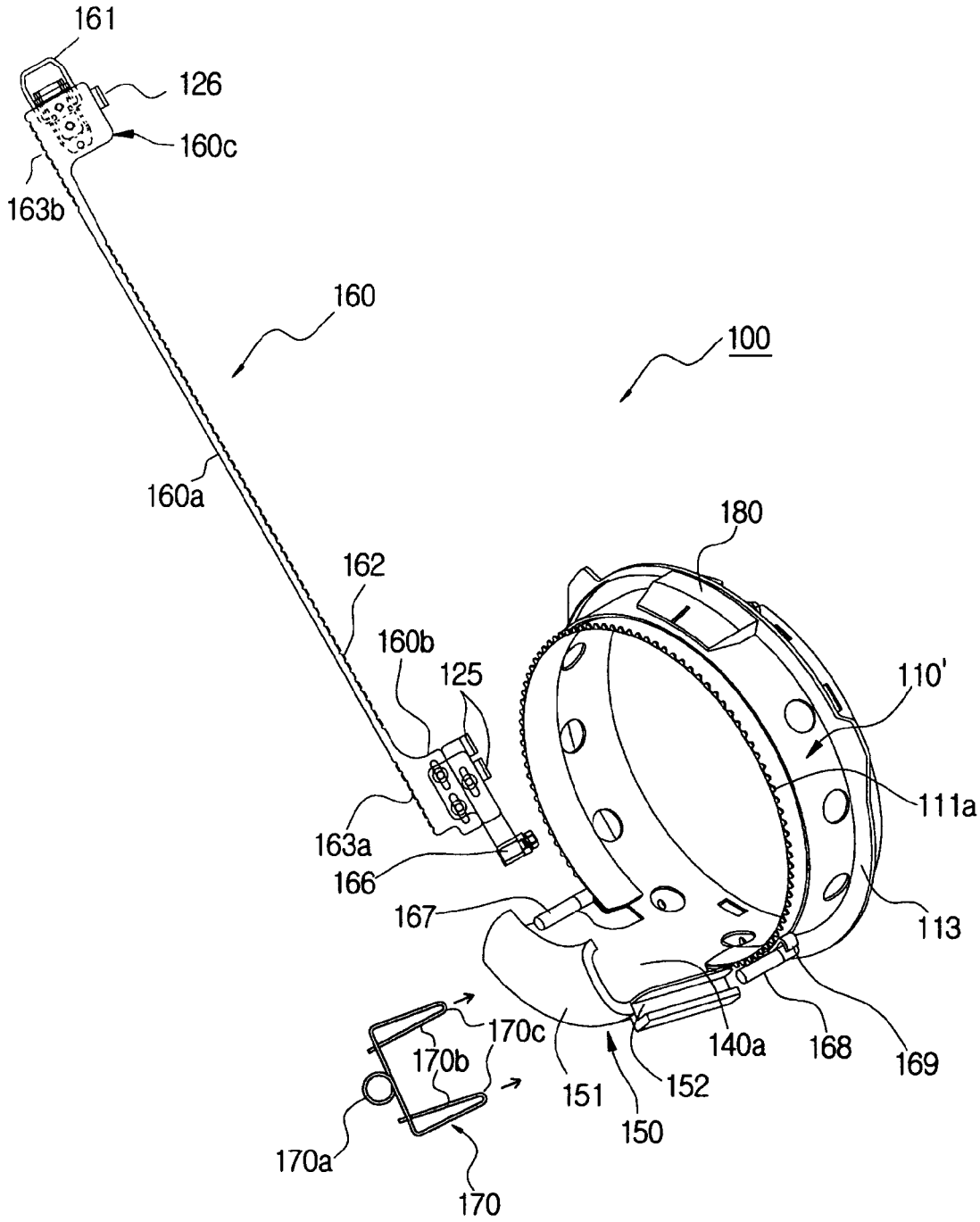
FIG. 11 is a perspective view of a cap holding device according to a third embodiment of the present invention.
Figure 12:
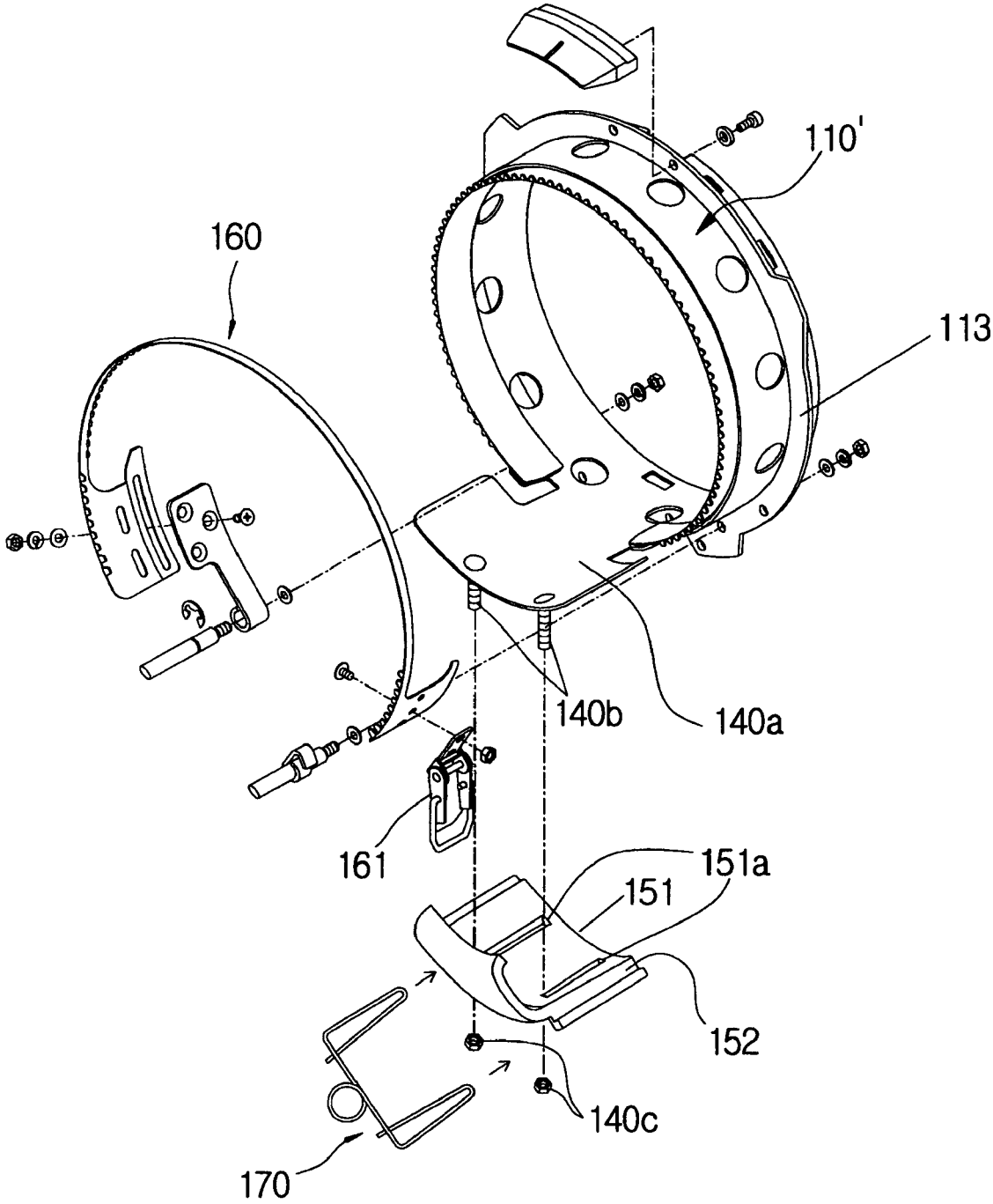
FIG. 12 is an exploded perspective view of a cap holding device shown in FIG. 11.

FIG. 11 is a perspective view of a cap holding device according to the third embodiment of the present invention, and FIG. 12 is an exploded perspective view of the cap holding device shown in FIG. 11. As shown in FIGS. 11 and 12, the cap holding device according to the third embodiment of the present invention includes a holding member 110' having a cylindrical shape for mounting a cap 10 thereon, a pressing member 160 for maintaining the cap 10 in the holding member 110', and a cap-shape keeping section 150. The cap-shape keeping section 150 extends from a circumferential portion of the holding member and can adjust its height so as to tensely maintain the cap 10 according to the size (depth) of the cap 10. Reference numeral 170 is a cap holding clip used for fixing the cap mounted on the cap holding device. The cap holding clip 170 has a handle part 170*a*, a coupling part 170*b* and a guide part 170*c*.

The holding member 110' is provided at a lower portion thereof with a flange section 113 outwardly extending at a right angle from the lower portion of the holding member 110'. In addition, a semicircular or a saw-tooth type protrusion part 111*a* is outwardly protruded at a right angle from an upper end of the holding member 110'.

First and second rods 167 and 168 are vertically formed on the flange section 113 corresponding to both sides of the cap-shape keeping section 150 along a central axis of the holding member 110'. A locking protrusion 169 is formed in the second rod 168. In addition, a center block 180 is installed on the flange section 113 in opposition to the first and second rods 167 and 168 while spacing from the circumferential surface of the holding member 110' by a predetermined distance.

The pressing member 160 includes a pressing section 160*a* having an elongated plate shape, a first expansion section 160*b* extending widthwise from one end of the pressing section 160*a*, and a second expansion section 160*c* extending widthwise from the other end of the pressing section 160*a*. The pressing section 160*a* has a first semicircular or saw-tooth type tooth part 162 formed on an upper portion of the pressing section 160*a* in such a manner that the first semicircular or saw-tooth type tooth part 162 is protruded towards the holding member 110' when a fastening member 161 formed at one end of the pressing member 160 is coupled to the locking protrusion. Preferably, the fastening member 161 includes a buckle. The first expansion section 160*b* includes a second semicircular or saw-tooth type tooth part 163*a* formed on a lower portion of the pressing section 160*a* in opposition to the first semicircular or saw-tooth type tooth part 162, a hollow cylindrical type rotating part 166 formed at a distal end of the first expansion section 160*b* and rotatably coupled to the first rod 167, and at least one "ㄷ" shaped fixing part 125 formed widthwise at the end of the first expansion section 160*b* and coupled to the flange section 113. The second expansion section 160*c* includes a third semicircular or saw-tooth type tooth part 163*b* formed on the lower portion of the pressing section 160*a* in opposition to the first semicircular or saw-tooth type tooth part 162, the fastening member 161 formed at the distal end of the of the second expansion section 160*c* and coupled to the locking protrusion 169, and at least one "ㄷ" shaped fixing part 126 formed widthwise at the end of the second expansion section 160*c* and coupled to the flange section 113.

It is possible to selectively form at least one "ㄷ" shaped fixing part at one of the first or second expansion sections 160*b* or 160*c*.

Figure 13:
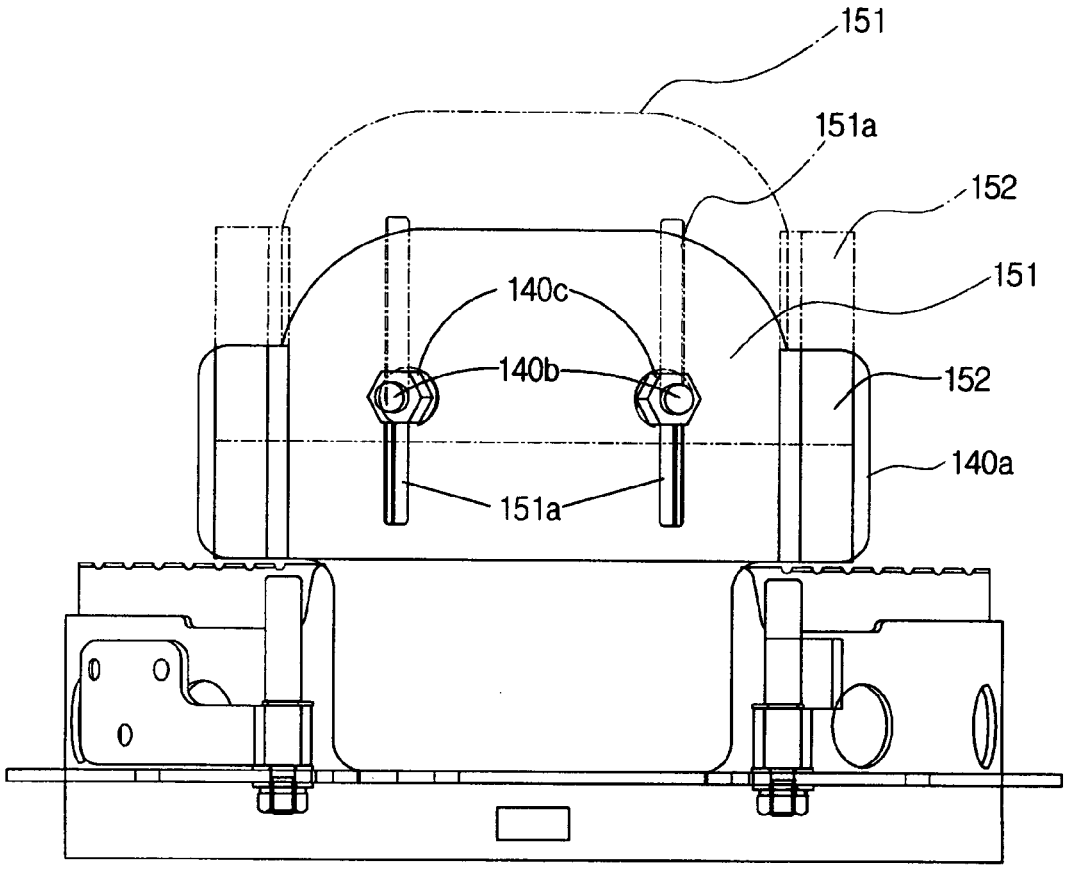
FIG. 13 is a view showing a position shifting state of a supporting plate shown in FIG. 11.

In addition, as shown in FIGS. 12 and 13 in detail, the cap-shape keeping section 150 includes a holding plate 140*a* extending from a circumferential portion of the holding member 110', and a cap-shape supporting plate 151 coupled to the holding plate 140*a* and capable of adjusting height thereof according to the size (depth) of the cap in order to tensely maintain the cap. The holding plate 140*a* includes a pair of protrusion pins 140*b*, which are formed at a predetermined position of the holding plate 140*a* while spacing from each other by a predetermined distance. Preferably, the protrusion pins 140*b* include bolts or male screws, but they are not limited thereto. The cap-shape supporting plate 151 includes a body section having a shape corresponding to a shape of the holding plate 140*a* so as to easily make contact with the holding plate 140*a*, a pair of elongated slots 151*a* formed at a predetermined position of the body section corresponding to the protrusion pins 140*b* and having a width sufficient for allowing the protrusion pins 140*b* to be inserted into the elongated slots 151*a*, and grooves 152 formed at both sides of the body section so as to receive the holding clip 170. In addition, an upper end of the cap-shape supporting plate 151 has a curved shape in order to smoothly maintain the cap when the cap is mounted on the cap holding device for the embroidery work. As shown in FIG. 12, the cap-shape supporting plate 151 is coupled to the holding plate 140*a* by means of a coupling device 140*c*, such as nuts or female screws, in a state that the protrusion pins 140*b* are inserted into the elongated slots 151*a*.

FIG. 13 is a view showing the cap-shape supporting plate 151 coupled to the holding plate 140*a* in the cap-shape keeping section 150, in which height of the cap-shape supporting plate 151 is adjusted. As shown in FIG. 13, height of the cap-shape supporting plate 151 can be adjusted according to the size (depth) of the cap by moving the cap-shape supporting plate 151 up and down along the slots 151*a*. The cap-shape supporting plate 151 shown in FIG. 13 in a solid line represents lowest height of the cap-shape supporting plate 151 and the cap-shape supporting plate 151 shown in FIG. 13 in a dotted line represents highest height of the cap-shape supporting plate 151.

Figure 14:
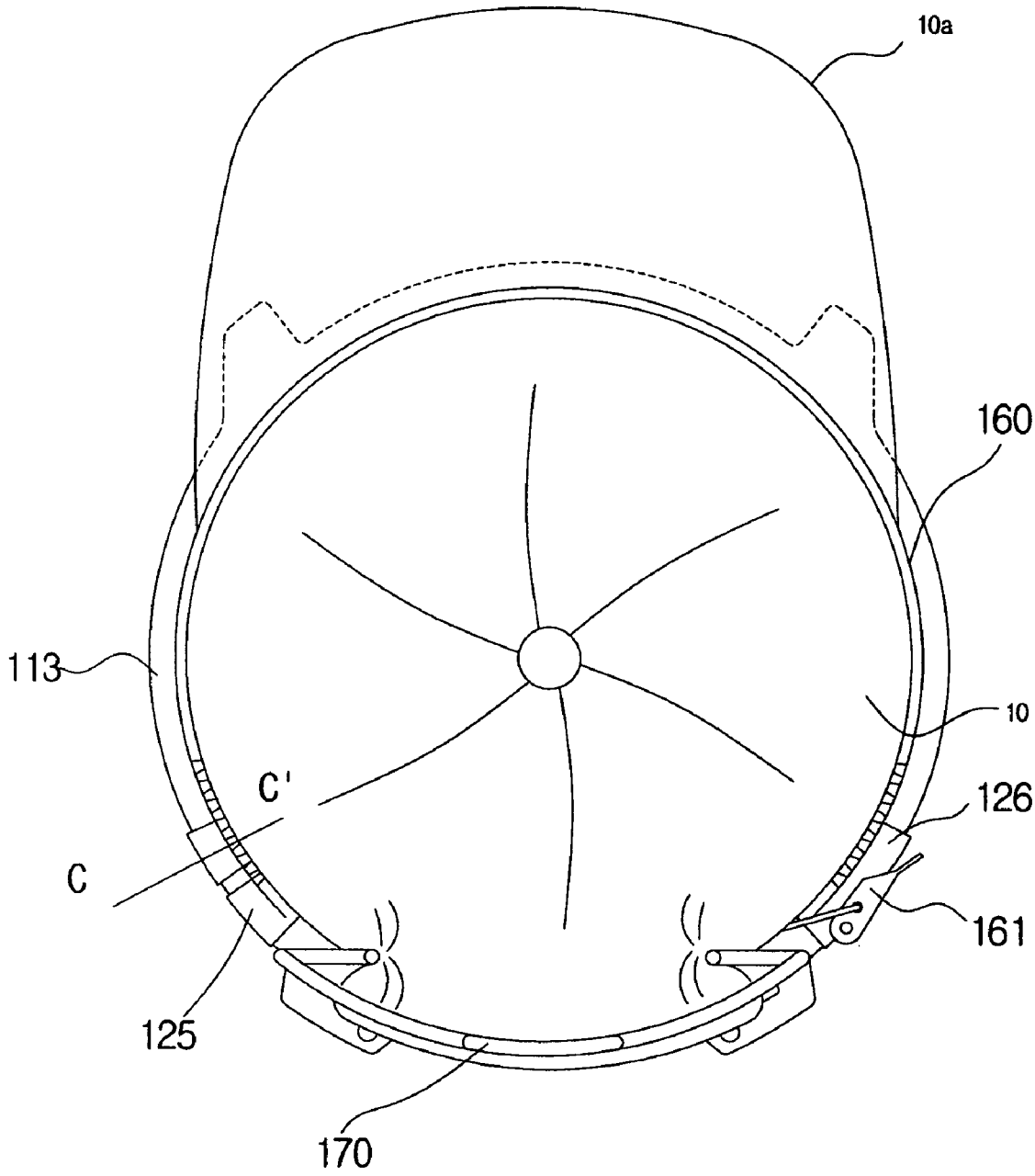
FIG. 14 is a plan view showing a cap mounted on a cap holding device shown in FIG. 11.
Figure 15:
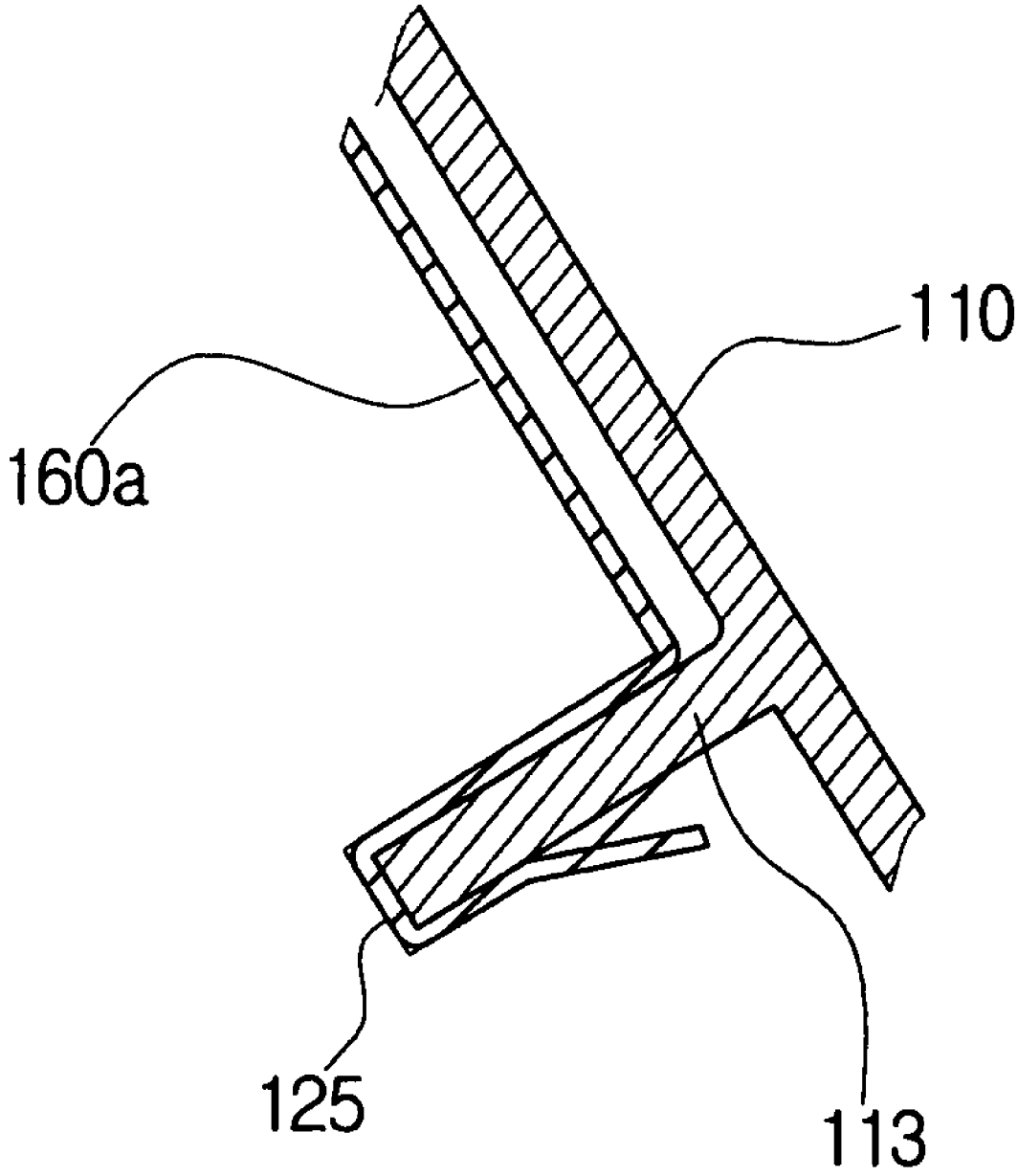
FIG. 15 is a sectional view taken along a line C–C' shown in FIG. 11.

FIG. 14 is a plan view showing the cap mounted on the cap holding device shown in FIG. 11 and FIG. 15 is a sectional view taken along a line C–C' shown in FIG. 11, in which the pressing section 160*a* of the pressing member 160 and at least one fixing part 125 or 126 formed at both sides of the pressing member 160 are coupled to the flange section 113.

Hereinafter, a method for mounting the cap on the cap holding device according to the third embodiment of the present invention will be described in detail.

Firstly, the fastening member 161 of the pressing member 160 is released from the locking protrusion 169 and the non-embroidery region of the cap 10 is positioned towards the cap-shape keeping section 150. In this state, the cap 10 is mounted on the cap holding device 100. It is preferred to adjust height of the cap-shape keeping section 150 (that is, the cap-shape supporting plate 151) according to the size of the cap 10 before mounting the cap 10 on the cap holding device 100. Then, the pressing member 160*a* is bent along the circumferential direction of the holding member 110' about the rotating part 166 coupled to the first rod 167 so as to couple the fastening member 161 to the locking protrusion 169. In order to couple the fastening member 161 to the locking protrusion 169, at least one "ㄷ" shaped fixing part 125 or 126 formed at both side ends of the pressing member 160 are coupled to the flange section 113 as shown in FIG. 15. In addition, the holding clip 170 is inserted into the grooves 152 of the cap-shape holding section 150 (that is, the grooves 152 formed in the cap-shape supporting plate 151) from an upper portion of the cap 10. When the cap 10 is mounted on the cap holding device 100 through the above-described manner, a rim of the cap 10 is securely maintained while being prevented from being slid by means of the protrusion part 111*a* of the holding member 110', the first tooth part 162 of the pressing section 160*a*, and second and third tooth parts 163*a* and 163*b* of the expansion section. In this state, the holding clip 170 securely fixes the cap 10 so that the cap 10 mounted on the cap holding device 100 can maintain the original shape thereof.

According to the cap hold device of the present invention, the cap can be easily mounted on the cap holding device in a simple manner so that workability and productivity can be improved.

In addition, the embroidery region of the cap is precisely provided when performing the embroidery work and the cap is tensely maintained without forming a wrinkle therein, so that embroidery designs are formed in a precise position of the cap, thereby improving quality of embroidery articles.

Furthermore, a worker can easily carry the cap holding device by gripping the handle section of the holding member, which extends in a forward direction.

In addition, since the cap holding device has a simple structure with a graceful external appearance, the manufacturing process of the cap holding device can be simplified, thereby reducing manufacturing cost.

According to the present invention, the embroidery work can be precisely carried out with respect to various kinds of caps as required by a user regardless of the size (depth) of the caps.

Although preferred embodiments of the present invention has been described for illustrative purposes, those skilled in the art will appreciate that various modifications, additions and substitutions are possible, without departing from the scope and spirit of the invention as disclosed in the accompanying claims.

The present disclosure relates to subject matter contained in priority Korean Patent Application No. 2003-0007532, filed on Mar. 13, 2003, the contents of which is herein expressly incorporated by reference in its entirety.

What is claimed is:

1. A cap holding device comprising:

a holding member configured to mount a cap thereon;

a pressing member detachably coupled to the holding member so as to maintain the cap in the holding member; and at least one fixing part formed at one end or both ends of the pressing member and fixed to the holding member, wherein the pressing member includes a first pressing member configured to maintain an embroidery region in the holding member, and a second pressing member detachably coupled to a coupling part, at which the first pressing member is coupled to the holding member, so as to fix a non-embroidery region of the cap to the holding member, wherein the holding member includes a first supporting surface, a part of which is cut away, the first supporting surface configured to support the embroidery region of the cap, and a second supporting surface configured to support the non-embroidery region of the cap, the second supporting surface having two extension parts forwardly extending from both side ends of the first supporting surface and a connection part configured to connect both ends of the extension parts to each other in parallel to the first supporting surface, a free end of the second supporting surface being positioned at a front of a moving route of a needle, and wherein a receiver configured to receive a second cap fixing part formed at a distal end of the second pressing member is formed at one of two extension parts of the second supporting surface.

2. The cap holding device as claimed in claim 1, wherein the extension parts are formed in such a manner that a curved line is formed from upper ends of the extension parts forming the second supporting surface to both side ends of the first supporting surface.

3. The cap holding device as claimed in claim 1, further comprising a flange section outwardly extending at a right angle from lower portions of the first supporting surface and the extension parts of the second supporting surface, which extend from both side ends of the first supporting surface, and a protrusion part outwardly protruded at a right angle from an upper end of the first supporting surface.

4. The cap holding device as claimed in claim 3, wherein a coupling member is vertically installed at one end of the flange section, the first and second pressing members are coupled to the coupling member, and a coupling protrusion for the first pressing member is formed on the first supporting surface in opposition to the coupling member.

5. The cap holding device as claimed in claim 1, wherein a fastening member is formed at a distal end of the first pressing member and a locking protrusion is formed at a distal end of the second pressing member, the fastening member of the first pressing member is coupled to the locking protrusion of the second pressing member and configured to hold the cap in the holding member.

6. The cap holding device as claimed in claim 5, wherein the first pressing member includes a pressing section having an elongated plate shape, a first expansion section extending widthwise from a first end of the pressing section, and a second expansion section extending widthwise from a second end of the pressing section, and at least one "C" shaped fixing part fixed to the flange section is formed in the first expansion section and/or the second expansion section.

7. The cap holding device as claimed in claim 5, wherein the second pressing member includes a second rotating part rotatably coupled to the coupling member and a handle section, the handle section having an upper member extending from an upper end of the second rotating part and having a shape corresponding to the connection part of the second supporting surface, a lower member extending from a lower end of the second rotating part while being spaced from the upper member by a predetermined distance and having a shape corresponding to the upper member, and a connection member configured to connect the lower member to the upper member.

8. The cap holding device as claimed in claim 7, wherein a second cap fixing part inserted into the receiver formed in one of the extension parts of the second supporting surface is provided at an outer end of the connection member, a first cap fixing part extends from the second rotating part formed between the upper and lower members in such a manner that the first cap fixing part makes contact with the extension parts of the second supporting surface adjacent to the second rotating part, and a locking protrusion is formed at an outer portion of the connection member in opposition to the lower member.

9. A cap holding device comprising:

a holding member configured to mount a cap thereon;

a pressing member detachably coupled to the holding member so as to maintain the cap in the holding member;

at least one fixing part formed at one end or both ends of the pressing member and fixed to the holding member, a cap-shape keeping section extending from a circumferential portion of the holding member and capable of adjusting height thereof so as to tensely maintain the cap according to a size of the cap, wherein the cap-shape keeping member includes a holding plate extending from the circumferential portion of the holding member and a cap-shape supporting part capable of adjusting height thereof so as to tensely maintain the cap based on a size of the cap, and wherein the holding plate includes a pair of protrusion pins installed in the holding plate and spaced from each other by a predetermined distance, and the cap-shape supporting part includes a body section having a shape corresponding to a shape of the holding plate so as to easily make contact with the holding plate, a pair of elongated slots formed at a predetermined position of the body section corresponding to the protrusion pins and having a width sufficient for allowing the protrusion pins to be inserted into the elongated slots, and grooves formed at both sides of the body section.

10. The cap holding device as claimed in claim 9, wherein an upper end of the cap-shape supporting part has a curved shape in order to smoothly maintain the cap when the cap is mounted on the cap holding device for an embroidery work and the cap-shape supporting part is coupled to the holding plate by a coupling device in a state that the protrusion pins are inserted into the elongated slots.

11. The cap holding device as claimed in claim 9, further comprising a holding clip inserted into the grooves in order to securely support the cap.

12. A cap holding device comprising:

a holding member configured to mount a cap thereon;

a pressing member detachably coupled to the holding member so as to maintain the cap in the holding member;

at least one fixing part formed at one end or both ends of the pressing member and fixed to the holding member, a cap-shape keeping section extending from a circumferential portion of the holding member and capable of adjusting height thereof so as to tensely maintain the cap according to a size of the cap, and wherein a flange section is outwardly protruded at a right angle from a lower portion of the holding member, first and second rods are installed on the flange section corresponding to both sides of a holding plate along a central axis of the holding member, and a locking protrusion is installed in the second rod.

13. The cap holding device as claimed in claim 12, wherein the pressing member includes a pressing section having an elongated plate shape, a first expansion section extending widthwise from a first end of the pressing section, and a second expansion section extending widthwise from a second end of the pressing section, the first expansion section has a hollow cylindrical rotating part rotatably coupled to the first rod, the second expansion section has a fastening member coupled to the locking protrusion formed in the second rod, and at least one "C" shaped fixing part coupled to the flange section is formed in the first expansion section and/or the second expansion section.

* * * * *